United States Patent [19]

Engelke

[11] 4,417,512

[45] Nov. 29, 1983

[54] CAN CRUSHER

[76] Inventor: Henry C. Engelke, 1701 S. Walker La., Stockton, Calif. 95205

[21] Appl. No.: 321,111

[22] Filed: Nov. 13, 1981

[51] Int. Cl.[3] ..... B30B 9/32

[52] U.S. Cl. ..... 100/266; 100/295; 100/902

[58] Field of Search ..... 100/902, 295, 266, 240, 100/245, 268, 231; 99/578

[56] References Cited

U.S. PATENT DOCUMENTS

| | | | |
|---|---|---|---|
| 2,161,931 | 6/1939 | Pattison | 100/902 |
| 2,178,461 | 10/1939 | Apprill | 100/902 |
| 2,466,907 | 4/1949 | Nadolny | 100/902 |
| 2,563,379 | 8/1951 | Smith | 100/902 |
| 2,614,604 | 10/1952 | Coffey | 100/902 |
| 2,678,000 | 5/1954 | Scheidt | 100/266 |
| 3,009,414 | 11/1961 | Griemert | 100/902 |
| 3,299,802 | 1/1967 | Black | 100/902 |
| 3,411,722 | 11/1968 | Webber | 100/902 |
| 3,438,322 | 4/1969 | Marasco | 100/233 |
| 3,515,057 | 6/1970 | Aldridge | 100/268 |
| 3,988,978 | 11/1976 | Flick | 100/902 |
| 4,133,261 | 1/1979 | Belfils | 100/902 |

*Primary Examiner*—Billy J. Wilhite

[57] ABSTRACT

An improved can crushing device designed to crush cans such as aluminum beverage containers for recycling purposes comprises a vertically reciprocating plunger 60, the faceplate 68 of which acts in conjunction with an elevated can platform 26, mounted on a primary column 10 to exert force at the top and bottom of the can 100 to effectuate the crushing process. A handlebar 62 attached at the top and a footbar 82 attached at the bottom of the plunger assembly 60 provides a means for the operator simultaneously to apply force from arm and leg muscles and body weight to crush the can. A suppressor 16 is built into the primary column to permit the operator to gain and maximize the use of momentum at the first and at the final stages of the crushing process and to absorb the abrupt reduction of downward movement at the last stage of the crushing process. A return spring 28 holds the device at its fully extended height except during the crushing process. The device also has anti-slip hand grips 64, and foot pads 86, and a resilient base surface 14 to maximize safety during its operation.

11 Claims, 10 Drawing Figures

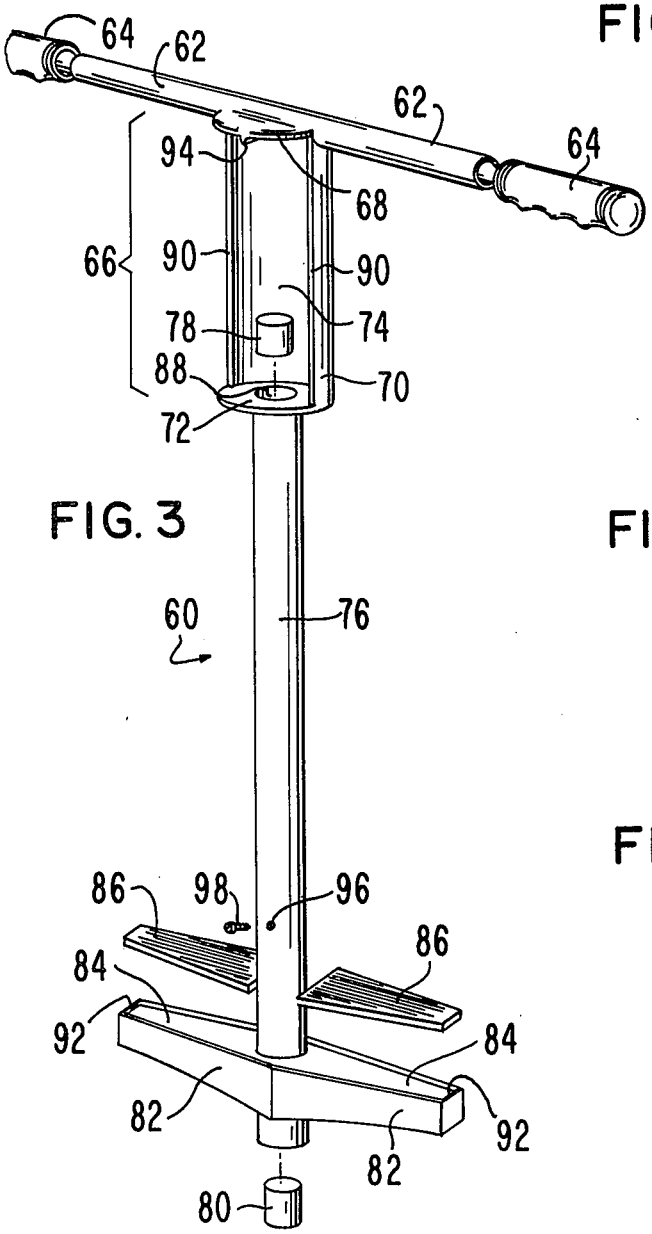
FIG. 3
FIG.4A
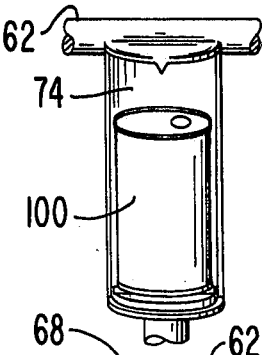
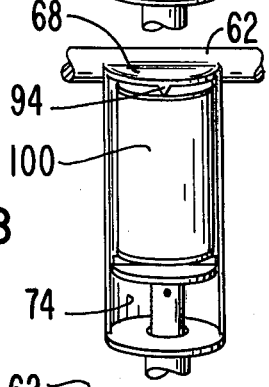
FIG.4B
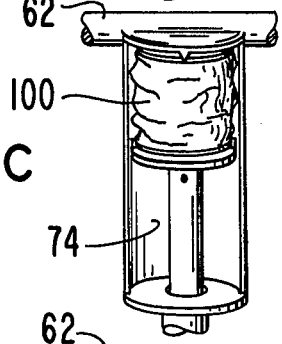
FIG.4C
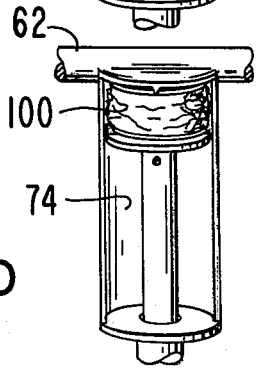
FIG.4D

CAN CRUSHER

BACKGROUND

1. Field of Invention

This invention relates to crushing and compacting devices. More specifically, this invention relates to the crushing and compacting of used cans such as aluminum beverage containers to conserve storage space and to simplify their handling and transportation.

The practice of salvaging aluminum cans because of their cash value has become commonplace by individuals, households, businesses, civic, and charitable groups. This practice has been given impetus because of increased use of disposable aluminum cans, particularly by the beverage industry. The establishment of numerous aluminum recycling centers by industry has further encouraged the collection of aluminum cans. The above developments have made it economically attractive for individuals, households, and others to salvage aluminum cans as a supplemental source of income.

2. Description of Prior Art

Uncrushed cans in large numbers require an inordinate amount of storage space relative to space usually available to the average collector and relative to their resale value. As a result, to conserve space collectors have resorted to crushing cans using a variety of methods, including the use of feet or hands, or using a hammer or other heavy objects.

Prior art can crushing devices have not attained wide acceptance in the marketplace. This is believed due to the fact that most such devices have relatively cumbersome and complex mechanisms which often require attachment to other objects to be operable. Most lack ready portability and one such device lacks means to flatten cans uniformly, particularly if rigidity of the supporting surface varies as the operator moves from can to can.

OBJECTS OF THE INVENTION

Accordingly several objects of the invention are to provide a device which will crush cans of various heights and diameters without the need for manual adjustment and which is designed to enable inserting, crushing, and removing the can in a single synchronized operation at a height which enables the operator to expeditiously apply force to crush the can.

The device is designed to be portable for operation on any firm surface such as parksites, sidewalks, roadsides, or kitchen floors without damage to the supporting surface, but has alternate means for stationary installation. The device also has anti-slip hand grips and foot pads and a resilient base surface to maximize safety during its operation.

Additional objects of this invention are to provide a can crushing device which is simple to use and which can be operated by persons in a variety of age groups including youths and seniors; which has a minimum of moving parts and which will require minimal maintenance and repair; which is streamlined, distinctive and pleasing in appearance, and which has no nonfunctional parts or appendages; which has a controlled crushing aperture to preclude injury to the operator or bystanders; which because of its cost, operation and general appeal will encourage the increasing trend toward recycling of aluminum cans; which will be in a cost range that makes it reasonably available to persons of all income groups and which can produce income on a profit-making basis; which can be flexibly attached to a floor, wall, or other stable object or to a base of sufficient size and weight to support the device if a permanent installation is preferred by the operator; which will quickly, efficiently and uniformly crush cans including partially-damaged or mutilated cans to approximately one-fourth of original volume and into a shape which facilitates handling, storage and transportation for disposal or reclamation purposes; which when not in use can be stored or placed at rest in any convenient upright or horizontal position such as in a broom closet, kitchen, service porch, garage, or trunk of an automobile; which can be economically constructed from lightweight plastic or metal or a combination of plastic, metal or other durable, lightweight material; which lends itself to economical mass production using extrusion, fabrication, prefabrication, or a combination of manufacturing methods; which, because of its portability, precision and convenience of operation, design and cost, will obviate the disadvantages of prior art devices. The specific nature of the invention as well as other objects, uses and advantages thereof, will appear clearly from the following description and from the accompanying drawings, the different views of which are not necessarily to the same scale.

BRIEF DESCRIPTION OF THE DRAWINGS

FIG. 3 is an exploded view of the plunger of the preferred embodiment.

FIGS. 4A, 4B, 4C and 4D are partial front views of the can crusher depicting four stages, A through D, of the crushing process.

DESCRIPTION OF THE PREFERRED EMBODIMENT

Figure 1:
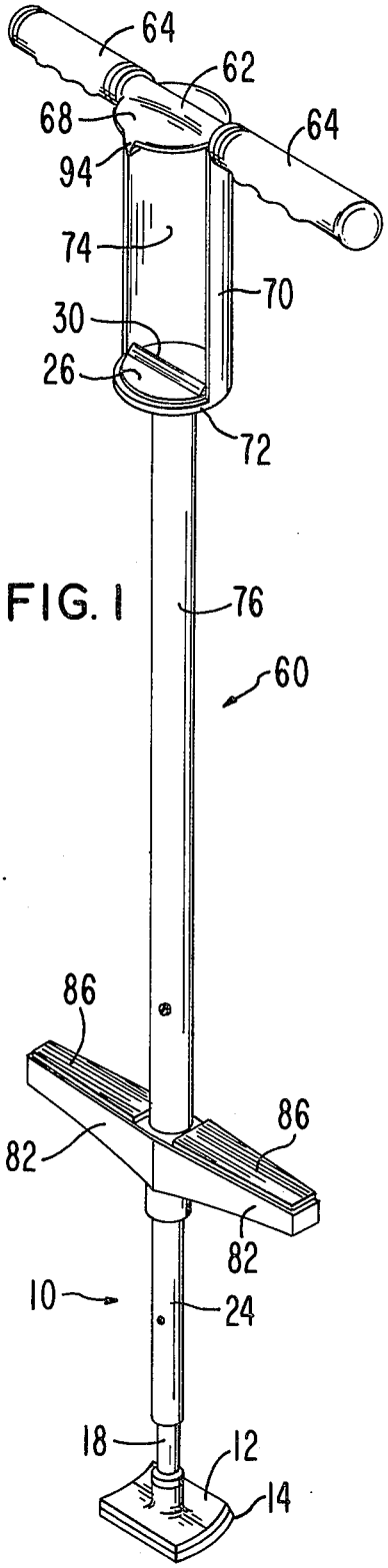
FIG. 1 is a front perspective view of the preferred embodiment of the can crusher.

FIG. 1 shows a fully-assembled can crushing device, which is comprised of a primary column 10 and a vertically reciprocative plunger 60. The overall height of a presently-preferred embodiment of the assembled can crusher is approximately 91 cm. (36 inches). Because of its telescopic action, the height is reduced to approximately 76 cm. (30 inches) at the end of the can crushing process. The can crusher returns to its full height at completion of the can crushing cycle. The can crushing device may be constructed of metal or plastic, or a combination of metal or plastic or other suitable material by means of extrusion, casting, molding, prefabrication, or a combination of manufacturing methods.

Figure 2:
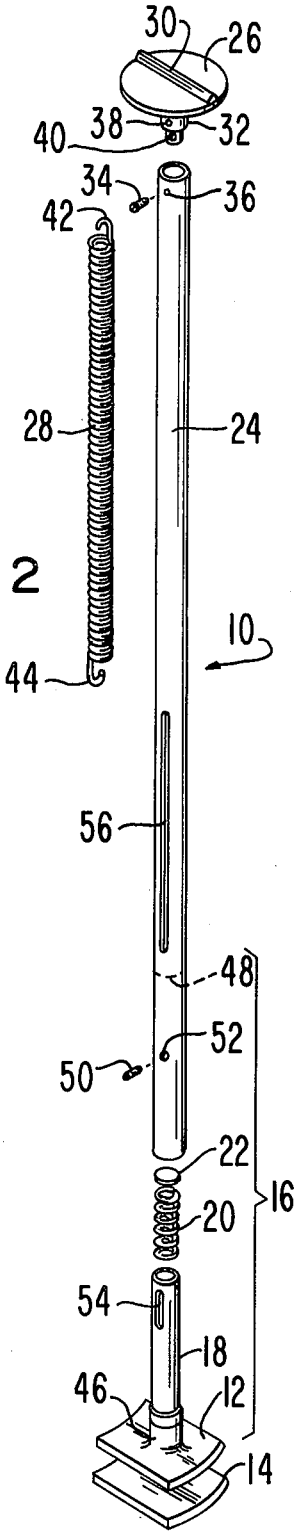
FIG. 2 is an exploded view of the primary column assembly of the preferred embodiment.

FIG. 2 shows an exploded view of primary column 10 consisting of a vertically-disposed primary column shaft 24; a return spring 28; a base 12, and a base anti-slip pad 14; a spring loaded suppressor unit 16 comprised of a suppressor stem 18, a suppressor spring 20, and a spring barrier disk 22; and a horizontally disposed can piston 26. The vertically-disposed primary column shaft 24 is of hollow tubular construction with an outside diameter of approximately 2.5 cm. (1 inch) and a length of approximately 66 cm. (26 inches) and having a longitudinal slot 56 which extends downward approximately 18 cm. (7 inches) from a point approximately 35.5 cm. (14 inches) from the top of the shaft. Threaded hole 52 is located upward approximately 7 cm. (2.75 inches) from the bottom of the shaft and countersunk hole 36 is located downward approximately 1.3 cm. (½ inch) from the top of the shaft. Both holes and the slot are in alignment along one longitudinal side of the shaft. Spring barrier disc 22 is permanently installed in a flat horizontal position within the shaft at location 48. Return spring 28 is a pull-type spring with hooks 42 and 44 on opposite ends, with a contracted static length of approximately 33 cm. (13 inches) and with a resiliency capability for repeated expansion to approximately 53 cm. (21 inches) and contraction to its static length. The return spring has an outside diameter of suitable size to permit a slidable fit within primary column shaft 24.

Base 12 is rectangular with its top face attached removably and horizontally to the lowermost end of suppressor stem 18 at centralized location 46. The lower face of base 12 is convex along the longitudinal side opposite from the entry side of slot 54 in suppressor stem 18. The lower face of base anti-slip pad 14 follows the same rectangular and longitudinal convex shape as base 12 and its upper concave surface is attached to the lower convex face of base 12.

In relation to the construction of the spring loaded suppressor unit 16, the suppressor stem 18 is approximately 11 cm. (4.5 inches) in length and has an outside diameter slightly smaller than the inside diameter of primary column shaft 24, permitting the top end of the suppressor stem to be slidably mounted within the lowermost end of primary column shaft 24. The bottom end of suppressor stem 18 is fastened to the top surface of base 12 at a centralized location as indicated by 46. Slot 54 in the suppressor stem is approximately 3 cm. (1.25 inches) in length and penetrates the full diameter of the suppressor stem, going downward from a point approximately 1.3 cm. (½ inch) from the top of the stem, with the entry side of the slot representing the front of the stem. The line formed by the slot from the front to the back of the stem is positioned at a right angle to the longitudinal sides of base 12.

The suppressor unit 16 is assembled by inserting the spring barrier disc 22 upwardly into the primary column shaft 24 to a point indicated by dashed line 48, where it is permanently fastened, as by welding, in a flat horizontal position. Suppressor spring 20 is then upwardly inserted into primary column shaft 24 until it is in contact with the lower surface of the spring barrier disc 22. Next, the top of the suppressor stem 18 is upwardly inserted into primary column shaft 24 until it is in contact with the bottom of suppressor spring 20 compressing it sufficiently to permit installation of setscrew 50 into threaded hole 52 of primary column shaft 24, and into slot 54 of suppressor stem 18.

Can piston 26 is a flat disc approximately 7.5 cm. (3 inches) in diameter. The base of triangular crimping bar 30, approximately 7.5 cm. (3 inches) in length and 0.8 cm. (5/16 inch) in height, is permanently fastened in a bisecting position, with the center of the base approximately 0.3 cm. (⅛ inch) forward from the circumferential center of the piston and with one longitudinal edge facing upward, to the upper side of can piston 26. A tubular extension 32, approximately 3.8 cm. (1.5 inches) in length, is permanently attached in a concentric position to the lower side of can piston 26. The outside diameter of tubular extension 32 is slightly less than the inside diameter of primary column shaft 24 to allow its insertion into the shaft during assembly of the device. A threaded hole 38 is located on one side of the tubular extension, to coincide with countersunk hole 36 in primary column shaft 24, and facing at a right angle in relation to the longitudinal direction of crimping bar 30. A loop 40 is permanently attached to the lowermost end of tubular extension 32.

FIG. 3 shows an exploded view of the vertically reciprocative plunger 60, which consists of a footbar 82 and antislip foot pads 86; an interconnector shaft 76 and two bushings 78 and 80; a can receptacle unit 66 consisting of plunger face plate 68, a receptacle wall 70, and a receptacle floor 72; a handlebar 62, and handlebar antislip grips 64.

In relation to the construction of the footbar unit, the foot bar 82 is approximately 25 cm. (10 inches) in length and is horizontally attached to interconnector shaft 76 with the lowermost edge of footbar 82 approximately 5 cm. (2 inches) from the extreme lower end of interconnector shaft 76. Footbar 82 extends at right angles an equal distance and height from opposite sides of interconnector shaft 76. The top surface of footbar 82 is recessed as indicated by 84. During assembly, antislip foot pads 86, each approximately 11 cm. (4.25 inches) in length, are permanently installed in recesses 84.

The hollow interconnector shaft 76 is approximately 50 cm. (20 inches) in length and has an outside diameter of approximately 3 cm. (1.25 inches). Interconnector shaft 76 extends upwardly from a point approximately 5 cm. (2 inches) below the lowermost edge of footbar 82, and at right angles through the longitudinal and latitudinal center of footbar 82, continuing upward to the bottom surface of receptacle floor 72 at which point it is concentrically attached. Bushing 80, with an inside diameter of suitable size to provide a slidable fit for primary column shaft 24 of FIG. 2, is press-fit upwardly into the bottom end of interconnector shaft 76, with its lower edge flush with the lower edge of interconnector shaft 76. Bushing 78, with the same inside diameter as bushing 80, is press-fit downwardly into the top end of interconnector shaft 76, with its top edge flush with the top edge of interconnector shaft 76.

In relation to the construction of the can receptacle unit 66, the receptacle floor 72 is a flat washer-type disc approximately 8 cm. (3.25 inches) in diameter having a centrally located hole 88 of the same diameter as the inside diameter of interconnector shaft 76. The lower surface of receptacle floor 72 is concentrically attached to the uppermost end of interconnector shaft 76. The outside diameter of receptacle floor 72 matches the concave inside diameter of receptacle wall 70. The receptacle wall 70 is a half cylinder approximately 19 cm. (7.5 inches) in length and approximately 8 cm. (3.25 inches) in diameter of a size suitable in diameter to enable longitudinal passage past can piston 26 during the crushing process. During assembly the receptacle wall 70 is placed in an upright position relative to its length and its concave side is fitted to the outside circumference of receptacle floor 72 with its extreme lower edge matched with the lower edge of receptacle floor 72, then permanently attached in this position, with the line formed across the front vertical edges 90 of receptacle wall 70 placed in a parallel position relative to the longitudinal line formed between points 92 on footbar 82.

The plunger faceplate 68 is a flat disc approximately 8 cm. (3.25 inches) in diameter. The outside circumference of plunger faceplate 68 is fitted into the concave side of receptable wall 70, and the upper edge of plunger faceplate 68 is matched with the extreme upper edge of receptacle wall 70, then permanently attached in this position. The base of a triangular crimping bar 94, approximately 8 cm. (3 inches) in length and 0.8 cm. (5/16 inch) in height, is permanently fastened to the lower surface of plunger faceplate 68 in a centrally bisecting position, with one longitudinal edge facing downward in a position substantially at right angles to the crimping bar 30 on piston 26 and the line formed across the front vertical edges 90 of receptacle wall 70.

In relation to the construction of the handlebar unit, a tubular handlebar 62, approximately 30 cm. (12 inches) in length, horizontally bisects the upper side of plunger faceplate 68. Handlebar 62 is horizontally recessed to a depth approximately ½ of its diameter, at a midway point relative to its length, said recess corresponding in length to the circumferential outline of receptacle wall 70. The recess in handlebar 62 is fitted to the upper side of plunger faceplate 68 and adjacent areas of receptacle wall 70 with the front longitudinal edge of the recess corresponding to the line formed across front edges 90 of receptacle wall 70, after which handlebar 62 is permanently attached to the top of the can receptacle unit. The two handlebar anti-slip grips 64, which are tubular with an inside diameter approximately equivalent to the outside diameter of handlebar 62, are then laterally installed as in FIG. 1.

Assembly of the complete can crushing device to correspond with FIG. 1 is accomplished as follows: The top end of primary column shaft 24, FIG. 2, with assembled base unit 12 and assembled suppressor unit 16 in place, is inserted upwardly into the extreme bottom end of interconnector shaft 76, FIG. 3, passing through bushing 80, and to a point flush with the top of bushing 78 and with slot 56 in alignment with hole 96, shaft 24 thus becoming the inner shaft of the preferred embodiment. Spring 28 is inserted into the top end of hollow primary column shaft 24 in a downward direction until hook 44 is in alignment with hole 96, after which setscrew 98 is installed into threaded hole 96 passing through slot 56 and securing hook 44. A looped wire or other suitable tool is then used to secure hook 42 of spring 28 drawing it sufficiently upward to enable passage of hook 42 through loop 40 of can piston 26 after which tubular extension 32 of can piston 26 is inserted into primary column shaft 24 where it is secured by insertion of setscrew 34 through hole 36 and into threaded hole 38, thereby completing the assembly of the can crushing device.

OPERATION OF THE PREFERRED EMBODIMENT

With reference to FIG. 1, in operation handlebar 62 is gripped with both hands by the operator and the can crusher is placed in front of the operator in an upright position with the open end of the can receptacle chamber 74 facing away from the operator. The base of the can crusher is placed at a distance approximately 40 cm. (16 inches) in front of the operator's feet. The handlebar is held approximately 15 cm. (6 inches) from the operator's midriff. The operator then releases one of handlebar grips 64, using the free hand to place a can 100 into can receptacle chamber 74 in a position as shown in FIG. 4A. After again gripping handlebars 64 with both hands, the operator depresses the handlebars until crimping bar 94 attached to the plunger faceplate 68 is in contact with the top of the can as shown in FIG. 4B. The operator then places one foot on the footbar 82 and, using force from the weight of the body and arm and leg muscles, pushes the plunger downward through stages FIG. 4C and FIG. 4D, thereby crushing the can.

After the can has been crushed the operator releases the downward pressure on the handlebar and footbar. Spring 28, FIG. 2, automatically returns the plunger 60, FIG. 1, upward to ready position. The operator then removes the crushed can from the can receptacle, replaces it with an uncrushed can and repeats the can crushing cycle.

A description of the specific function of each of the various components of the can crushing device is as follows: The primary column 10, FIG. 2, consisting of base 12; a spring-loaded suppressor unit 16 comprised of stem 18, spring 20 and disc 22, and setscrew 50; primary column shaft 24 and can piston 26 provides a means by which the can to be crushed is placed upon a stable and portable surface within easy reach of the operator.

The function of base 12 and attached base anti-slip pad 14, which is constructed from rubber or other durable resilient material, is to distribute the downward thrust of the can crusher during operation, making it possible to operate the can crusher on a variety of surfaces including kitchen or garage floors, sidewalks, or roadsides without danger of slippage or damage to the supporting surface. The bottom convex shape of the base and pad permits the can crusher to be held at an angle toward the operator for maximum utilization of body weight and arm and leg muscle force, without sacrificing the downward force distribution and the antislip safety features of the base design.

The function of the spring-loaded suppressor unit 16, comprised of suppressor stem 18, suppressor spring 20, and spring barrier disc 22, is to permit the operator to build momentum before expending the maximum amount of force needed to collapse the can structure. Slot 54 in the suppressor stem permits reciprocal vertical motion of the stem within primary column shaft 24 past setscrew 50 which controls the upper and lower limits of reciprocal motion and also prevents rotation of the suppressor stem in relation to its position within the primary column shaft as shown in FIG. 1. When the operator begins to exert downward force at stage FIG. 4B, the compression spring absorbs the downward force until that point in time when the combined operator force and the force stored in the compressed spring overcomes the resistance offered by the can's structure. As the can begins to collapse, its resistance is reduced, enabling the stored force within the compressed spring to expand the spring to its original length, thereby accelerating the crushing process. This in turn accelerates the momentum generated by the continuing force expended by the operator through stage FIG. 4C. As the crushing process begins to reach stage FIG. 4D, the compacted can structure gradually offers increased resistance with the result that the suppressor spring is again compressed, enabling maximum utilization of the operator's momentum for the final crushing action and absorbing the abrupt reduction of downward movement at the final stage of the crushing process. The compressor spring returns to its normal length on cessation of downward force by the operator after the crushing process is completed.

The primary column shaft 24 serves as a rigid supporting connector between the combined base and suppressor units and the can piston 26, elevating the can piston to make it convenient for the operator to place uncrushed cans into the can receptacle chamber 74 and to remove cans after the crushing process. Slot 56, FIG. 2, provides passage for setscrew 98, FIG. 3, as the plunger travels down and up during the crushing process. The slot and setscrew also prevent rotation of primary column 10 in relation to its position within plunger 60 as shown in FIG. 1.

The purpose of can piston 26 is to serve as a stationary shelf upon which the can is placed preparatory to the crushing process. The can piston serves to hold the can at a static elevation as the can receptacle unit moves down upon the can during the crushing process. The upper edge of crimping bar 30, which bisects the top surface of can piston 26, slightly forward of center, serves to initially tilt the can backwards into the can receptacle chamber 74, then serves to hold the can in position by biting into opposite edges of the can's bottom circumference while it is being crushed and also serves to crimp the bottom of the can at these two points when the crushing process is in stages FIG. 4B and FIG. 4C. This crimping action causes the initial collapse of the can's lower structure and reduces the amount of energy needed to complete the can crushing process.

The plunger 60, FIG. 3, consisting of footbar 82, interconnector shaft 76, can receptacle unit 66 comprised of floor 72, wall 70, and plunger faceplate 68, and handlebar 62, serves as a unitized vertically reciprocative means through which downward force is applied to the top of can by the operator to effectuate the crushing process.

Footbar 82 at the lower end of interconnector shaft 76 is designed for use by either foot during the can crushing process. The function of the footbar is to provide a means for delivery of downward force from the operator's leg muscles and body weight to the interconnector shaft. The footbar anti-slip pads 86, constructed of rubber of other resilient material and inserted into the recesses in the top surfaces of the footbar are for safety purposes to prevent the operator's foot from slipping from the footbar and to absorb resistive force generated during the can crushing process.

The function of interconnector shaft 76, which slidably surrounds and encases shaft 24, is to stabilize the vertical position of the plunger in relation to the primary column and to serve as a rigid link transmitting downward force applied to footbar 82 by the operator to the can receptacle unit. The bushings mounted at the top and bottom ends of said interconnector shaft reduce the surface area in contact with the inner shaft as the plunger reciprocates down and up during the crushing process, thereby allowing a maximum amount of the energy expended by the operator to be used for the crushing process. Setscrew 98 which installs into threaded hole 96 in the interconnector shaft serves to retain hook 44 of spring 28. Setscrew 98 also passes through slot 56 of primary column shaft 24 preventing rotation of the primary column in relation to its position within the plunger as shown in FIG. 1. As a safety measure setscrew 98 also acts as a stop against the lower end of slot 56, preventing complete closure of the can receptacle chamber 74 if the device is inadvertently operated without a can in the can receptacle.

The can receptacle unit 66, comprised of plunger faceplate 68, receptacle wall 70, and receptacle floor 72, serves as a receiver to hold the can in an upright position before and during the crushing process. Receptacle floor 72 serves as the connecting means between interconnector shaft 76 and receptacle wall 70, which in turn serves as the connecting means between receptacle floor 72 and receptacle plunger faceplate 68. The lower edge of crimping bar 94, which bisects the lower surface of the plunger faceplate 68, serves to hold the can in position by biting into opposite edges of the can's top circumference as the plunger moves down upon the can during the crushing process and also serves to crimp the top of the can at these two points when the crushing process is in stages FIG. 4B and FIG. 4C. This crimping action causes the initial collapse of the can's upper structure and, in concert with crimping bar 30 on can piston 26, reduces the amount of energy needed to complete the can crushing process.

The handlebar 62, attached to the top surface of plunger faceplate 68, serves as a means for the operator to carry the can crusher, to stabilize it during operation and as a point on which to transmit downward force from the operator's arm muscles and upper body to plunger faceplate 68. The handlebar anti-slip grips 64, constructed of rubber or other resilient material, are installed at both ends of the handlebar for safety purposes to prevent the operator's hands from slipping from the handlebars during the can crushing process, while carrying the can crusher, or when placing the can crusher in operational position.

The function of pull spring 28, FIG. 2, is to provide a means to hold the assembled can crusher in its fully extended position as in FIG. 1, and as in FIG. 4A, in order to facilitate placement of cans into can receptacle chamber 74. A further function of the pull spring is to telescopically return the can crusher to its fully extended position after the plunger has been forced downward during the can crushing process, thereby completing the operational cycle.

ALTERNATIVE EMBODIMENT (FIGS. 5 THROUGH 7)

Figure 5:
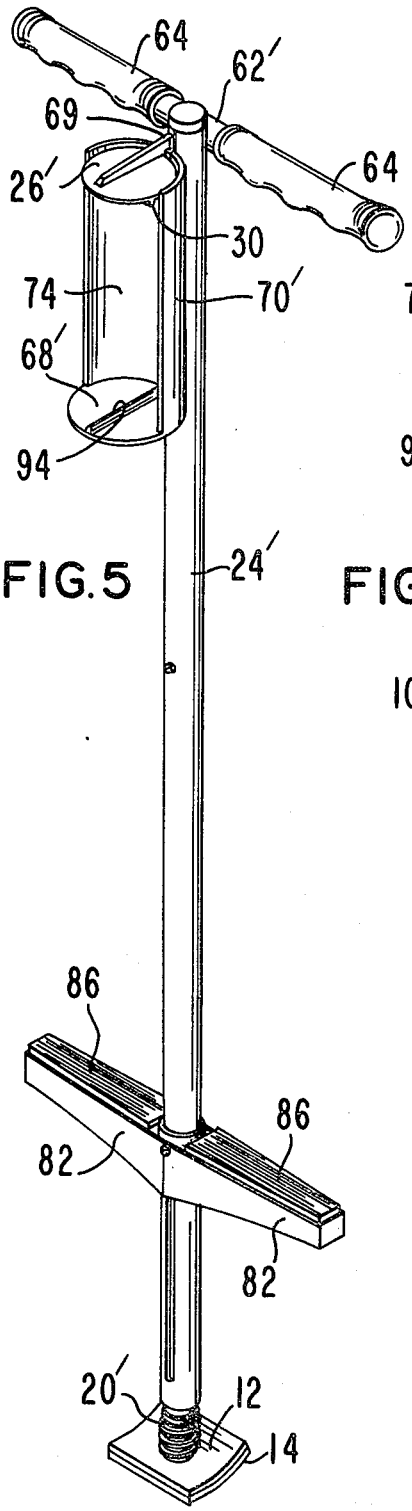
FIG. 5 is a front perspective view of an alternate embodiment of the can crusher.
Figure 6:
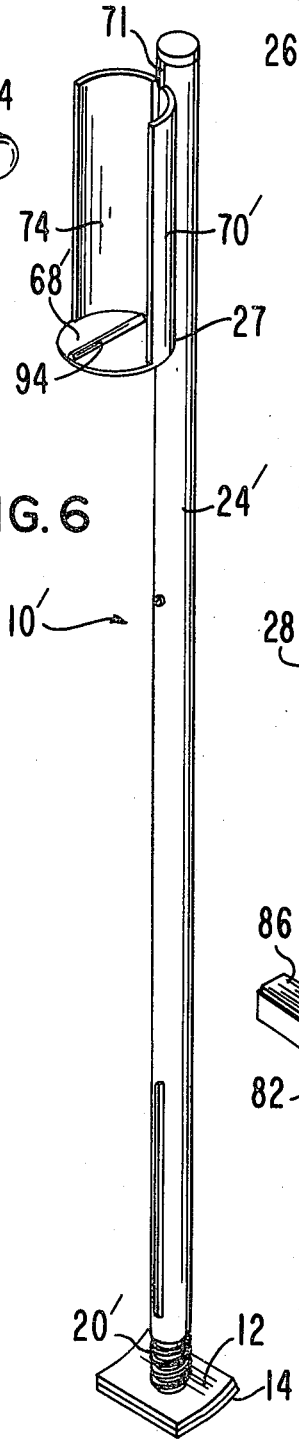
FIG. 6 is a view of the primary column of the alternate embodiment.
Figure 7:
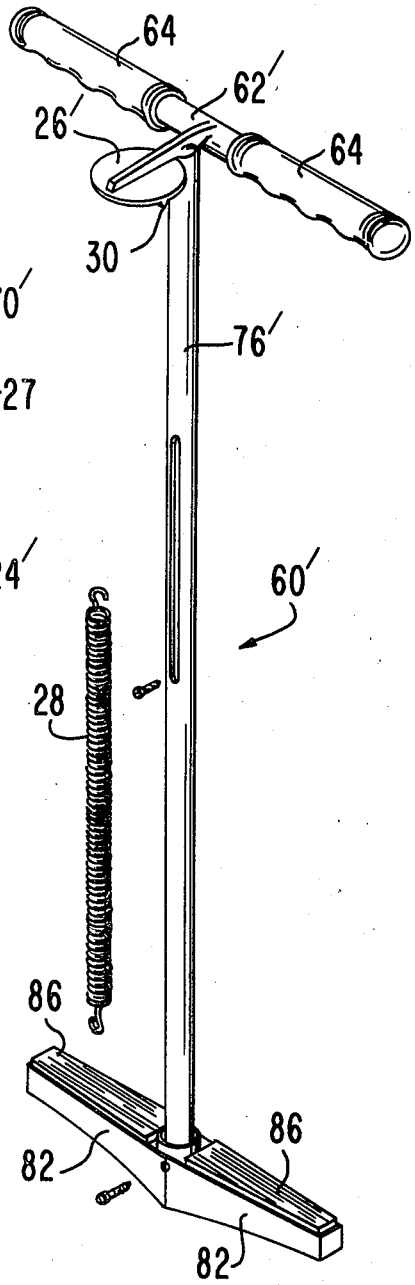
FIG. 7 is a view of the plunger assembly of the alternate embodiment.

FIGS. 5 through 7 illustrate an alternate embodiment of the can crushing device which has structural variations from the preferred embodiment, FIG. 1, but which has components and function identical to the preferred embodiment. In the alternative embodiment, interconnector shaft 76' of FIG. 7 is the inner shaft in relation to primary column shaft 24' of FIG. 6, while in the preferred embodiment interconnector shaft 24 of FIG. 2 is the inner shaft in relation to interconnector shaft 76, FIG. 3. Primary column shaft 24' of FIG. 6 is approximately 20 cm. (8 inches) longer, beginning at location 27, than primary column shaft 24 of FIG. 2 of the preferred embodiment; this provides a means for attaching receptacle wall 70' and faceplate 68' in a front offset position to the front edge of primary column shaft 24' upwardly beginning at location 27 of FIG. 6, to serve as a can receiver. Faceplate 68' and its crimping bar 94 (FIGS. 5 and 6) of the alternate embodiment have the same function as faceplate 68' and crimping bar 94 (FIG. 3), except that faceplate 68' of the alternate embodiment is mounted at the bottom edge of receptacle wall 70, with its crimping bar 94 facing upward, instead of at the top edge of receptacle wall 70', with its crimping bar 94 facing downward, as in FIG. 3 of the preferred embodiment.

Receptacle wall 70' of FIG. 6 in the alternate embodiment remains stationary during the crushing process instead of traveling down and up as part of the plunger in the preferred embodiment. Can piston 26' and its crimping bar 30, FIGS. 5 and 7, have the same function as can piston 26', and its crimping bar 30, (FIG. 2), except that the can piston is offset from interconnector shaft 76' with crimping bar 30 facing downward as in FIG. 7 instead of concentrically attached to primary column shaft 24' with crimping bar 30 facing upward as in FIG. 2 of the preferred embodiment. Can piston 26' of the alternate embodiment reciprocally travels down and up within stationary receptacle wall 70', held in suitable offset position by extension arm 69 (FIG. 5), instead of traveling up and down as in the preferred embodiment. Suppressor spring 20' (FIG. 6) of the alternate embodiment is mounted externally instead of internally as in FIG. 2 of the preferred embodiment. Return spring 28, FIG. 7 of the alternate embodiment mounts within interconnector shaft 76' instead of within primary column shaft 24 (FIG. 2) of the preferred embodiment. As is readily apparent to any person skilled in the art to which this invention pertains, the remaining components, base 12, footbar 82 and handlebar 62 of the preferred and alternate embodiments, have the same construction and function and it is also apparent that the preferred embodiment and the alternative embodiment have the same function and equal capability to meet the basic object of crushing and compacting cans.

While the above description contains many specificities, these should not be construed as limitations on the scope of the invention, but rather as an exemplification of one preferred embodiment thereof. Variations within the scope of this invention include but are not limited by these additional ramifications: A horizontal indentation along one external side of tubular extension 32 (FIG. 2) with a matching internal protrusion from primary column shaft 24 would meet the function of setscrew 34, countersunk hole 36 and threaded hole 38 to prevent rotation of can piston 26 within shaft 24. Crimping bars 30 of FIG. 2 and 94 of FIG. 3, and crimping bars 94 of FIG. 6 and 30 of FIG. 7 will function regardless of the angle of one to the other but will function at optimum efficiency when positioned at right angles. The round tubular construction of the shafts of the preferred and alternate embodiments can be changed to square tube construction; this would eliminate the need for setscrews and slots to prevent rotation. The tubular and semi-tubular construction of the shafts, can container unit, handlebars and footbars of the preferred and alternate-embodiments may alternatively be made of a plurality of rods or tubes, cables or meshes or of a combination of singular shafts, plural rods, cables or tubes and meshes and flat stock. The portability of the preferred and alternate embodiments may be enhanced if base 11 is suitably enlarged to flexibly support the device in an upright position without fastening, or it may be attached to a floor or other horizontal surface or brackets may be used to flexibly attach the device to a wall or other vertical object for stationary mounting of the can crusher. Return spring 28, FIG. 2 and FIG. 7, may be mounted internally or externally of the device without impairing its function. Accordingly, the scope of the invention should be determined not by the embodiments illustrated, but by the appended claims and their legal equivalents.

What is claimed is:

1. A disposable container crushing device comprising:

a receiver shaped to hold a collapsible, disposable container, said receiver having a sidewall and an endwall extending at a substantially right angle from one end of said sidewall, said sidewall having a substantially circular curvature about an axis perpendicular to said endwall, a piston at the other end of said sidewall, said piston having a surface substantially parallel to said endwall and movable within said receiver from said other end of said sidewall to said one end thereof, a first elongated operating shaft attached to and extending from said receiver in an operating direction substantially parallel to said sidewall and the direction of travel of said piston, a second elongated operating shaft attached to and extending from said piston in said operating direction, and operating means for manually moving one of said operating shafts in said operating direction with respect to the other of said shafts, one of said operating shafts being tubular, said shafts both extending in the same direction from said receiver and said piston, the other of said operating shafts being an inner shaft telescoped within said tubular shaft, one of said shafts extending farther from said receiver than said other such that a portion of said one distal from said receiver extends beyond the end of said end of said other which is distal from said receiver, said operating means comprising (a) a pair of foot pedals extending perpendicularly out from said other of said shafts at the end thereof distal from said receiver in respectively opposite directions, and (b) a pair of handholds extending perpendicularly out from the portion of said device adjacent said receiver in respectively opposite directions corresponding to the respective directions in which said foot pedals extend, the distance between said foot pedals and said handholds being sufficiently great that a human can operate said device with his or her foot on one of said foot pedals while holding said handholds with his or her hands.

2. The device of claim 1 wherein said handholds are attached to said receiver and extend therefrom such that said receiver effectively can be grasped manually and said operating shaft can be foot-operated while said inner operating shaft is positioned against said floor, whereby manual and foot pressure can be combined to operate said device.

3. The device of claim 1 wherein said handholds are attached to said piston and extend therefrom such that said piston effectively can be held manually and said inner operating shaft can be foot operated while said tubular operating shaft is positioned against said floor, whereby manual and foot pressure can be combined to operate said device.

4. The device of claim 3 wherein said handholds are attached to said piston by an arm which extends through a slot in said sidewall of said receiver.

5. The device of claim 1 further including resilient means for returning said piston to said other end of said sidewall from said one end of said sidewall if said piston is moved to said one end of said sidewall.

6. The device of claim 1 further including resilient means for assisting the movement of said piston when it is moved from said other end of said sidewall to said one end of said sidewall.

7. The device of claim 6 further including resilient means for dissipating the velocity of said piston movement when said piston approaches said one end of said sidewall.

8. The device of claim 1 wherein said foot pedals are attached to said tubular one of said shafts, said inner and other of said operating shafts extending beyond said distal end of said tubular one of said shafts.

9. The device of claim 1 wherein said foot pedals are attached to said inner and other of said operating shafts, said tubular one of said shafts extending beyond said distal end of said inner shaft.

10. The device of claim 9 wherein said foot pedals are attached to said inner operating shaft via a slot in said tubular operating shaft.

11. The device of claim 1 wherein the surface of said piston and the facing surface of said endwall both contain an elongated raised portion, said elongated raised portions being orthogonally oriented, thereby to provide crimping bars.

* * * * *